United States Patent [19]

Stavenau

[11] 4,095,827

[45] Jun. 20, 1978

[54] WINDOW LOCK

[75] Inventor: Harold L. Stavenau, Owatonna, Minn.

[73] Assignee: Truth Incorporated, Owatonna, Minn.

[21] Appl. No.: 753,703

[22] Filed: Dec. 23, 1976

[51] Int. Cl.[2] ..... E05C 5/00

[52] U.S. Cl. ..... 292/65; 292/111; 292/DIG. 20; 292/DIG. 47

[58] Field of Search ..... 292/5, 6, 8, 63–65, 292/68, 69, 71, 111, 109, 110, DIG. 20, DIG. 47, DIG. 73; 70/90

[56] References Cited

U.S. PATENT DOCUMENTS

| | | | |
|---|---|---|---|
| 542,401 | 7/1895 | Anderson | 292/DIG. 20 |
| 774,206 | 11/1904 | Seaman | 292/210 X |
| 783,338 | 2/1905 | Ward | 292/68 X |
| 860,769 | 7/1907 | Tait | 292/DIG. 20 |
| 904,347 | 11/1908 | Mis | 292/176 |
| 1,180,474 | 4/1916 | Conwell | 292/DIG. 20 |
| 2,097,232 | 10/1937 | Hartman | 292/63 |
| 2,305,715 | 12/1942 | Keller | 292/111 X |
| 2,339,537 | 1/1944 | Wise | 292/110 |
| 2,997,323 | 8/1961 | Riser | 292/111 |
| 3,048,435 | 8/1962 | De Marco | 292/111 |
| 3,112,943 | 12/1963 | De Marco | 292/111 |
| 3,342,516 | 9/1967 | Morand | 292/6 |
| 3,360,290 | 12/1967 | De Gray | 292/6 |
| 3,706,467 | 12/1972 | Martin | 292/DIG. 20 |
| 3,844,591 | 10/1974 | Velcover | 292/7 |

*Primary Examiner*—Roy D. Frazier
*Assistant Examiner*—Rodney H. Bonck
*Attorney, Agent, or Firm*—Wegner, Stellman, McCord, Wiles & Wood

[57] ABSTRACT

A window lock and, more particularly, a check rail lock which can be mounted in association with a double hung window having a center vertical muntin. The window lock has a casing housing a linearly movable locking unit with locking members having a locking notch at one end for engagement with catch means carried by the adjacent window sash, an operating unit with operating members movably mounted in the casing and movable between window unlocked and locked positions and with pin and slot structure interconnecting the locking members and the operating members with the casing whereby the locking members are guided in the linear movement thereof to an advanced position as the operating unit moves toward the locked position and the locking members are then raised into engagement with the catch means and withdrawn to tightly draw and lock the window sash together as the operating unit moves to the final locked position.

6 Claims, 6 Drawing Figures

WINDOW LOCK

BACKGROUND OF THE INVENTION

This invention pertains to window locks and, more particularly, to a check rail lock having a pair of locking members that can move to each side of the vertical muntin of an adjacent double hung window sash to engage catch means mounted in the center of the window sash. The window lock incorporates novel structural elements for performing the window locking functions.

Many different types of check rail locks for double hung windows are known in the art. It is common procedure to install the check rail locks on residential double hung windows without mutins in the center of the horizontal check rail for esthetic reasons. On windows with a center vertical muntin or grill, it usually is impractical to position the check rail lock in the center of the horizontal check rail as the space usually accommodated by the check rail lock keeper or catch means is replaced by the vertical muntin. As a result, most known check rail locks are of a construction that must be offset from the center of the horizontal check rail in order to align with a lock keeper or catch means which is mounted at a position laterally displaced from the vertical muntin.

SUMMARY

A primary advantage of the invention disclosed herein is in the construction of a check rail lock for use with double hung window sash having a vertical muntin wherein the check rail lock may be mounted in the center of the horizontal check rail.

A feature of the invention is to provide a window lock wherein the parts of the window lock in moving to a final locked position cause a locking member to move outwardly to engage catch means carried by the upper window sash and then to have simultaneous upward and inward movement to align and seal double hung window sash tightly against the top and bottom of the window frame and draw the adjacent check rails of the window sash tightly together.

Still another feature is to provide a check rail lock having a casing mounting movable parts including a manually operable operating unit having a pair of operating members movable between locked and unlocked position, a locking unit having a pair of locking members movable between advanced and retracted positions and, in the advanced position, bringing a pair of locking notches into engagement with spaced-apart sections of a catch means positionable to either side of a window sash vertical muntin, and pin and slot means interconnecting the casing, the operating unit, and the locking unit whereby movement of the operating unit toward locked position causes advance of the locking unit to the advanced position to bring the locking notches into relation with the catch means and further movement of the operating unit causes simultaneous lifting and retracting of the locking unit for tight sealing of the check rail members of adjacent sash to each other and of the sash to the window frame with the forces being applied centrally because of the central mounting of the window lock relative to the window sash.

DESCRIPTION OF THE PREFERRED EMBODIMENT

Figure 1:
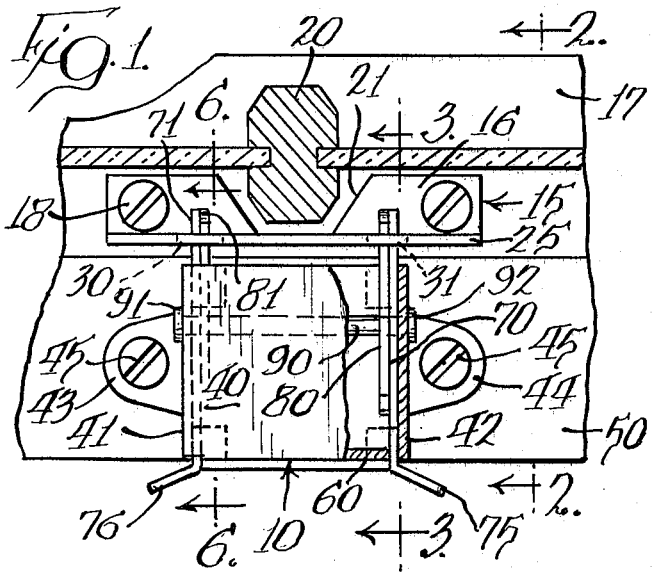
FIG. 1 is a plan view of the window lock shown in locked position in association with parts of a double hung window with parts of the window shown in section and parts of the window lock broken away.
Figure 2:
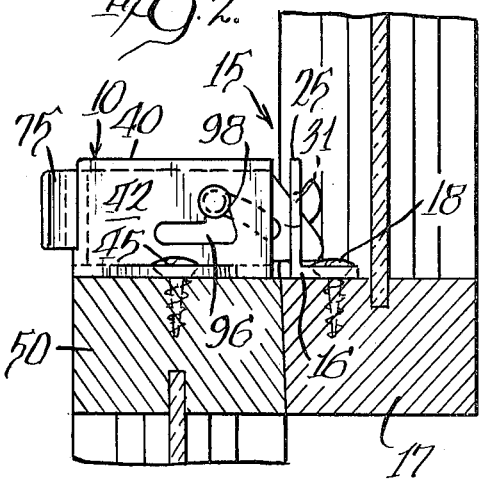
FIG. 2 is a vertical section, taken generally along the line 2—2 in FIG. 1.

The window lock disclosed herein is a check rail window lock intended primarily for use with double hung windows having adjacent upper and lower window sash as shown in the drawings. The window lock is also usable with other types of windows, such as horizontal windows having horizontal sliding panels.

The window lock has a casing, indicated generally at 10, mountable on a rail member of one window sash and housing the movable elements of the lock and a catch means, or keeper, indicated generally at 15, mountable on a rail member of the other window sash.

The catch means 15 is in the form of a sheet metal stamping with parts formed at right angles to have a planar base 16 which may be positioned upon the top surface of the lower check rail 17 of an upper sash of a double hung window and be fastened thereto by attachment members 18. The planar base 16 has a length to extend to either side of a vertical muntin 20 of the upper window sash and is recessed as shown in FIG. 1 at 21 to permit mounting of the catch means 15 centrally of the lower check rail 17 by spanning of the vertical muntin 20. An integral, vertically-extending planar section 25 of the catch means is positioned adjacent the meeting line of the check rails of the window sash and has two vertically-extending, generally rectangular slots 30 and 31 which terminate short of the upper edge of the planar section 25 to provide means for engagement by locking notches of locking members to be described.

The casing 10 forms an enclosure and guide structure for movable parts of the window lock, with the casing having a top wall 40 and a pair of side walls 41 and 42 depending therefrom. A pair of outwardly-turned flanges 43 and 44 associated one with each side wall receive attachment members 45 for mounting the casing to the upper check rail 50 of the lower window sash.

The depending side wall 41 has a pair of inwardly-turned guide tabs 51 and 52 lying in the same plane as the outwardly-turned flange 43 and the depending side wall 42 has a pair of inwardly-turned guide flanges 53 and 54 which lie in the same plane as the outwardly-turned flange 44.

The casing 10 has a depending rear wall 60 which terminates short of the plane of the guide tabs 51–54 and which also has its ends spaced from the depending side walls 41 and 42 to provide for movement and guiding of parts of an operating unit between the ends of the depending rear wall 60 and the inner surface of the depending side walls 41 and 42.

Figure 6:
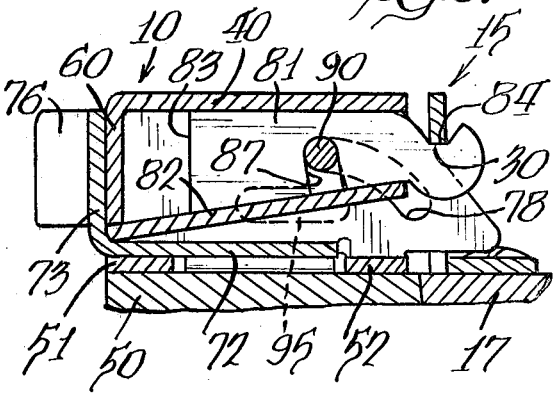
FIG. 6 is a vertical section, taken generally along the line 6—6 in FIG. 1, with the window lock in locked position.

The operating unit is preferably formed as a sheet metal stamping having two spaced-apart vertical sides 70 and 71 extending upwardly from a planar connecting section 72 which has an upwardly-turned planar rear panel 73 which coacts with the rear wall 60 of the casing to limit the movement of the operating unit to a locked position, as shown in FIG. 6. The planar sides 70 and 71 of the operating unit each form an operating member and pass between the ends of the depending rear wall 60 and lie adjacent the inner faces of the casing side walls 41 and 42. Angularly-extending tabs 75 and 76 at the rear of the operating members 70 and 71, respectively, provide a means for manual engagement to operate the lock and optionally provide an attaching means for a trim cover, if desired. The operating members 70 and 71 each have a downwardlyand forwardly curved slot 77 and 78, respectively, which form part of pin and slot means for causing operation of the lock structure. In the movements of the lock components, the operating unit is guided within the casing by having lower surface of the planar connecting section 72 movable on the guide tabs 51–54 and having the upper surfaces of the operating members 70 and 71 engage against the under surface of the casing top wall 40.

A locking unit preferably in the form of a sheet metal stamping has a pair of spaced-apart vertical sides 80 and 81 each forming a locking member and extending upwardly from a connecting planar section 82 which extends to the rear of an inclined rear edge 83 of the locking members. Each of the locking members 80 and 81 is of a height less than the vertical interior dimension of the casing 10 with a downwardly-inclined upper edge to permit a pivoting movement between a lower position, shown in FIGS. 3 and 4, and a final locking position, shown in FIG. 6. Each locking member has a shaped forward end to provide a pair of locking notches 83 and 84, respectively, to interfit with the rectangular slots 30 and 31 in the catch means to lock the window elements together. Additionally, each of the locking members 80 and 81 have an opening 86 and 87, respectively, extending therethrough and of a size to receive a guide pin 90 in the form of a generally round member and secured in position by enlarged heads 91 and 92 positioned externally of the casing 10.

The depending side walls 41 and 42 of the casing each have a slot therein with a horizontally-extending section 95 and 96 and an upwardly and rearwardly angled connecting section 97 and 98, respectively. The guide pin 90 extends through the slots in the casing side walls and also extends through the downwardly and forwardly curved slots 77 and 78 of the operating members of the operating unit. These connections along with extension of the guide pin through the openings 86 and 87 define pin and slot means for the window lock operation. The guide pin 90 associates the operating unit and the locking unit integrally with the casing 10 and provides a cam bearing member to actuate the locking unit in response to movement of the operating unit.

Figure 3:
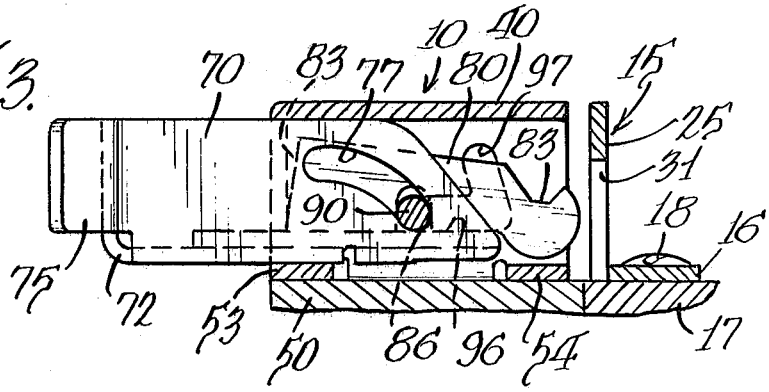
FIG. 3 is a vertical section, taken generally along the line 3—3 in FIG. 1 and with the window lock in unlocked position.
Figure 4:
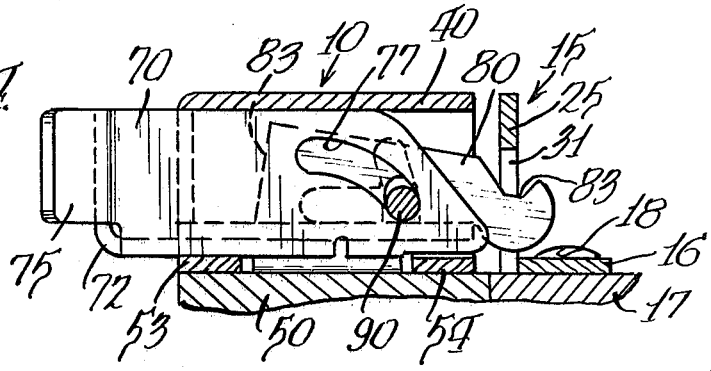
FIG. 4 is a view, similar to FIG. 3, showing the window lock in intermediate position and with a locking member fully advanced.

The window lock is shown in unlocked position in FIG. 3 with adjacent check rails 17 and 50 in general alignment. The operating unit is moved from the unlocked position, as shown in FIG. 3, toward the right by pressing on the operating tabs 75 and 76 which causes the guide pin 90 to move to the right and be retained at the lower end of the curved slots 77 and 78 because the guide pin is travelling in the horizontal sections 95 and 96 of the slots in the casing side walls. This advancing movement also simultaneously advances the locking unit because of the guide pin 90 extending through the openings 86 and 87 of the locking members. This initial stage of movement ends with the parts positioned as shown in FIG. 4 wherein the locking notches 83 and 84 have passed through the catch means slots 30 and 31 and have passed to both sides of the vertical muntin 20 of the upper window sash. Further advancing movement of the operating unit to the position shown in FIG. 5 causes the guide pin 90 to move upwardly relative to the curved slots 77 and 78 of the operating unit and, at the same time, to move rearwardly. This action results because the guide pin 90 must follow the upwardly and rearwardly angled sections 97 and 98 of the casing slots. This causes an upward pivoting and retracting movement of the locking members 80 and 81 to the position shown in FIGS. 5 and 6 to raise the upper sash and lower the lower sash to seat the sash tightly against the top and bottom of the window frame and the catch means 15 has been drawn toward the casing 10 to draw the check rails 17 and 50 tightly together. This pivoting action is facilitated by having the rear edge of the connecting planar section 82 of the locking unit underlying the depending rear wall 60 of the casing, as shown in FIGS. 4 and 6. The advance of the operating unit to the locked position is physically limited by the upwardly-turned planar rear panel 73 of the operating unit abutting against the depending rear wall 60 of the casing. Any force exerted on a window sash in a direction to unlock the window is ineffective to release the window lock.

Figure 5:
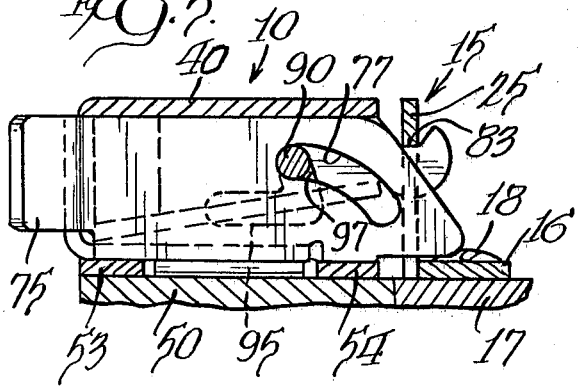
FIG. 5 is a view, similar to FIG. 3, showing the window lock in locked position.

Unlocking of the window lock is effected by movement of the operating unit toward the left, as viewed in FIGS. 5 and 6, and with the movement of the parts being the reverse of that described in the locking action, to have the parts returned to the unlocked condition, shown in FIG. 3.

I claim:

1. A window lock having catch means mountable on one window element and a locking member mountable on another window element with said locking member having a locking notch engageable with the catch means, means mounting said locking member for linear movement between an advanced position with said locking notch adjacent said catch means and a retracted position spaced from said catch means, said mounting means also enabling said locking member to pivot away from the direction of said linear movement, an operating member interconnected with said locking member for causing said linear movement of said locking member and mounted for movement between window unlocked and locked positions in one direction along a path extending generally toward said catch means, and means operable as said operating member approaches said window locked position and said locking member is in said advanced position to pivot said locking notch of said locking member into interengagement with the catch means and move the locking member a short distance in a direction away from said catch means to effect tight interengagement therebetween.

2. A window lock as defined in claim 1 wherein said catch means comprises a pair of spaced-apart catch elements, and there are two of said locking members to coact with said catch elements.

3. A window lock having a casing mountable on one window member, catch means mountable on an adjacent window member, a locking member having a locking notch at one end thereof mounted in said casing for linear movement between a retracted position and an advanced position, an operating member movably mounted in said casing and movable between window unlocked and locked positions, said casing, said operating member, and said locking member having pin and slot means including an opening in said locking member, the casing having a side wall with a slot formed therein configured to include a horizontal section and an upwardly angled section, a downwardly curved slot in said operating member, and a guide pin extending through said opening and said slots in the locking member and operating member, means guiding said locking member in said linear movement to said advanced position as the operating member moves toward said locked position and then to simultaneously raise and withdraw said locking member a short distance from said advanced position as the operating member moves to said locked position, whereby said raising of said locking member engages said locking notch with said catch means and said withdrawal of the locking member draws said catch means towards said casing.

4. A window lock as defined in claim 3 wherein said casing has a pair of spaced-apart side walls, a locking unit within said casing has a pair of said locking members spaced from each other to span a window muntin and an operating unit within said casing has a pair of said operating members.

5. A window lock having a casing mountable on a rail member of one window sash and a catch means mountable on an adjacent window sash with a pair of spaced catch elements positionable to either side of a window muntin or the like, said casing having a base, a top wall and a pair of spaced-apart side walls, a slot in each of said side walls having a first section extending parallel to said base and toward the front of the casing, and a connecting section extending upwardly and angled away from the front of the casing, an operating unit having a pair of spaced-apart planar operating members movably guided in said casing and movable between window unlocked and locked positions and each operating member having a curved slot which curves downwardly and toward the front of said casing, a locking unit having a pair of spaced-apart planar locking members with an opening therein and movable within the casing and having a locking notch at the end thereof, said locking unit being linearly movable between a retracted position and an advanced position with the locking notches outside said casing, and a guide pin extended through the openings of said planar locking members and the slots of the casing and operating members to guide the locking unit movement by movement along the slots of the casing side walls and said curved slots of the operating unit acting as cams on said guide pin to first push the guide pin along said first section of the side wall slots to advance the locking unit to said advanced position and to then move the guide pin along the connecting section of said side wall slots as the operating unit moves relative to the locking unit to move the locking notches into engagement with the catch elements and then draw the catch elements toward said casing.

6. A window lock as defined in claim 5 wherein said casing has a depending rear wall and said locking unit has a transverse planar section with an end positioned under said rear wall in said advanced position to provide a pivot point for pivoting of said locking unit as said guide pin moves along said connecting sections of the side wall slots.

* * * * *